US008740212B2

(12) United States Patent
Yasuda et al.

(10) Patent No.: US 8,740,212 B2
(45) Date of Patent: Jun. 3, 2014

(54) SHEET FOLDING DEVICE AND IMAGE FORMING APPARATUS WITH SHEET FOLDING DEVICE

(75) Inventors: Isao Yasuda, Aichi (JP); Ikumi Takashima, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 323 days.

(21) Appl. No.: 12/923,127

(22) Filed: Sep. 3, 2010

(65) Prior Publication Data

US 2011/0058876 A1 Mar. 10, 2011

(30) Foreign Application Priority Data

Sep. 8, 2009 (JP) ..... 2009-207066
Jun. 10, 2010 (JP) ..... 2010-133106

(51) Int. Cl.
*B65H 37/06* (2006.01)

(52) U.S. Cl.
USPC ..... 270/45; 270/32; 493/419; 493/405; 493/443

(58) Field of Classification Search
USPC ..... 270/32, 37, 45, 58.07, 58.08; 493/405, 493/419, 442, 443
See application file for complete search history.

(56) References Cited

U.S. PATENT DOCUMENTS 3,804,399 A * 4/1974 Rupp ..... 493/421
6,635,006 B2 * 10/2003 Auerbach et al. ..... 493/419
6,663,551 B2 * 12/2003 Auerbach et al. ..... 493/420
6,939,283 B2 * 9/2005 Sparano et al. ..... 493/424
7,731,187 B2 6/2010 Horio et al.
8,187,158 B2 * 5/2012 Vallonthaiel ..... 493/420
2003/0083183 A1 * 5/2003 Auerbach et al. ..... 493/419
2007/0176357 A1 8/2007 Horio et al.
2009/0062100 A1 3/2009 Takekawa et al.
2009/0129840 A1 5/2009 Takekawa et al.

FOREIGN PATENT DOCUMENTS

JP S6168069 U 5/1986
JP 2003-081529 3/2003
JP 03-812385 6/2006
JP 3812385 B2 * 8/2006

OTHER PUBLICATIONS

Japanese Office Action dated Feb. 18, 2014 for corresponding Japanese Application No. 2010-133106.

* cited by examiner

*Primary Examiner* — Patrick Mackey
(74) *Attorney, Agent, or Firm* — Harness, Dickey & Pierce, P.L.C.

(57) ABSTRACT

A sheet folding device includes a transport unit that transports a sheet; an abutting unit that abuts an end of the sheet being transported to form a bent portion at the sheet; a folding unit that nips the bent portion of the sheet by a pair of folding rollers to form a fold line in the sheet; a guide member that partially covers the folding roller and guides the sheet; and a position adjustment unit that adjusts a position of the guide member. An exposure amount of the folding roller with respect to the sheet can be varied by adjusting the position of the guide member through the position adjustment unit.

14 Claims, 7 Drawing Sheets

GRADIENT AMOUNT X-GUIDE PLATE ROTATION AMOUNT $\theta$ CONVERSION TABLE

| X | $\theta$ |
|---|---|
| -2mm | -2° |
| -1mm | -1° |
| DEFAULT | - |
| +1mm | +1° |
| +2mm | +2° |

SHEET FOLDING DEVICE AND IMAGE FORMING APPARATUS WITH SHEET FOLDING DEVICE

CROSS-REFERENCE TO RELATED APPLICATIONS

The present application claims priority to and incorporates by reference the entire contents of Japanese Patent Application No. 2009-207066 filed in Japan on Sep. 8, 2009 and Japanese Patent Application No. 2010-133106 filed in Japan on Jun. 10, 2010.

BACKGROUND OF THE INVENTION

1. Field of the Invention

The present invention relates to a sheet folding device that receives a sheet member (hereinafter, referred to simply as "sheet") such as a transfer sheet or a recording paper and performs a predetermined sheet folding operation such as single folding or Z folding and an image forming apparatus with the sheet folding device.

2. Description of the Related Art

Japanese Patent No. 3812385 discloses a technique of adjusting a gradient of a folding position by separately moving transport path guide plates divided into two, front and rear ones and separately changing distances from a folding roller 53 to a stopper 49. Japanese Patent Application Laid-open No. 2003-81529 discloses a technique of tilting a folding roller according to a sheet.

In the case of the invention disclosed in Japanese Patent No. 3812385, since the transport distances at to a stop member become different between front and rear sides due to gradient adjustment of the folding position, the length of the folding position in a sheet transport direction is greatly influenced. Thus, at the same time when adjusting the gradient of the folding position, it is necessary to adjust the length of the folding position in the sheet transport direction. Further, since the whole guide plate is moved, the transport path shape is distorted in the front and rear sides, wrinkles may occur. Further, the number of components increases, and a complicated mechanism is required.

In the case of the invention disclosed in Japanese Patent Application Laid-open No. 2003-81529, since the folding roller is tilted according to the sheet, the number of components increases, and a mechanism is very complicated.

SUMMARY OF THE INVENTION

It is an object of the present invention to at least partially solve the problems in the conventional technology.

According to an aspect of the present invention there is provided a sheet folding device, including: a transport unit that transports a sheet; an abutting unit that abuts an end of the sheet being transported to form a bent portion at the sheet; a folding unit that nips the bent portion of the sheet by a pair of folding rollers to form a fold line in the sheet; a guide member that partially covers the folding roller and guides the sheet; and a position adjustment unit that adjusts a position of the guide member. An exposure amount of the folding roller with respect to the sheet can be varied by adjusting the position of the guide member through the position adjustment unit.

According to another aspect of the present invention there is provided an image forming apparatus including a sheet folding device. The sheet folding device includes: a transport unit that transports a sheet; an abutting unit that abuts an end of the sheet being transported to form a bent portion at the sheet; a folding unit that nips the bent portion of the sheet by a pair of folding rollers to form a fold line in the sheet; a guide member that partially covers the folding roller and guides the sheet; and a position adjustment unit that adjusts a position of the guide member. An exposure amount of the folding roller with respect to the sheet can be varied by adjusting the position of the guide member through the position adjustment unit. The position adjustment unit has a pivot point axis that rotatably supports the guide member. The guide member is supported by the pivot point axis so that a rotation angle about the pivot point axis is adjustable. The pivot point axis is positioned at an end of the guide member in a direction orthogonal to a sheet transport direction. The image forming apparatus further includes: an image forming unit that forms an image on a sheet; a driving unit that rotatably drives the guide member; and an operation unit that operates the driving unit. A rotation angle of the guide member is adjusted by the operation unit.

According to still another aspect of the present invention there is provided an image forming apparatus, including: an image forming unit that forms an image on a sheet, and a sheet folding device. The sheet folding device includes: a transport unit that transports the sheet; an abutting unit that abuts an end of the sheet being transported to form a bent portion at the sheet; a folding unit that nips the bent portion of the sheet by a pair of folding rollers to form a fold line in the sheet; a guide member that partially covers the folding roller and guides the sheet; and a position adjustment unit that adjusts a position of the guide member. An exposure amount of the folding roller with respect to the sheet can be varied by adjusting the position of the guide member through the position adjustment unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
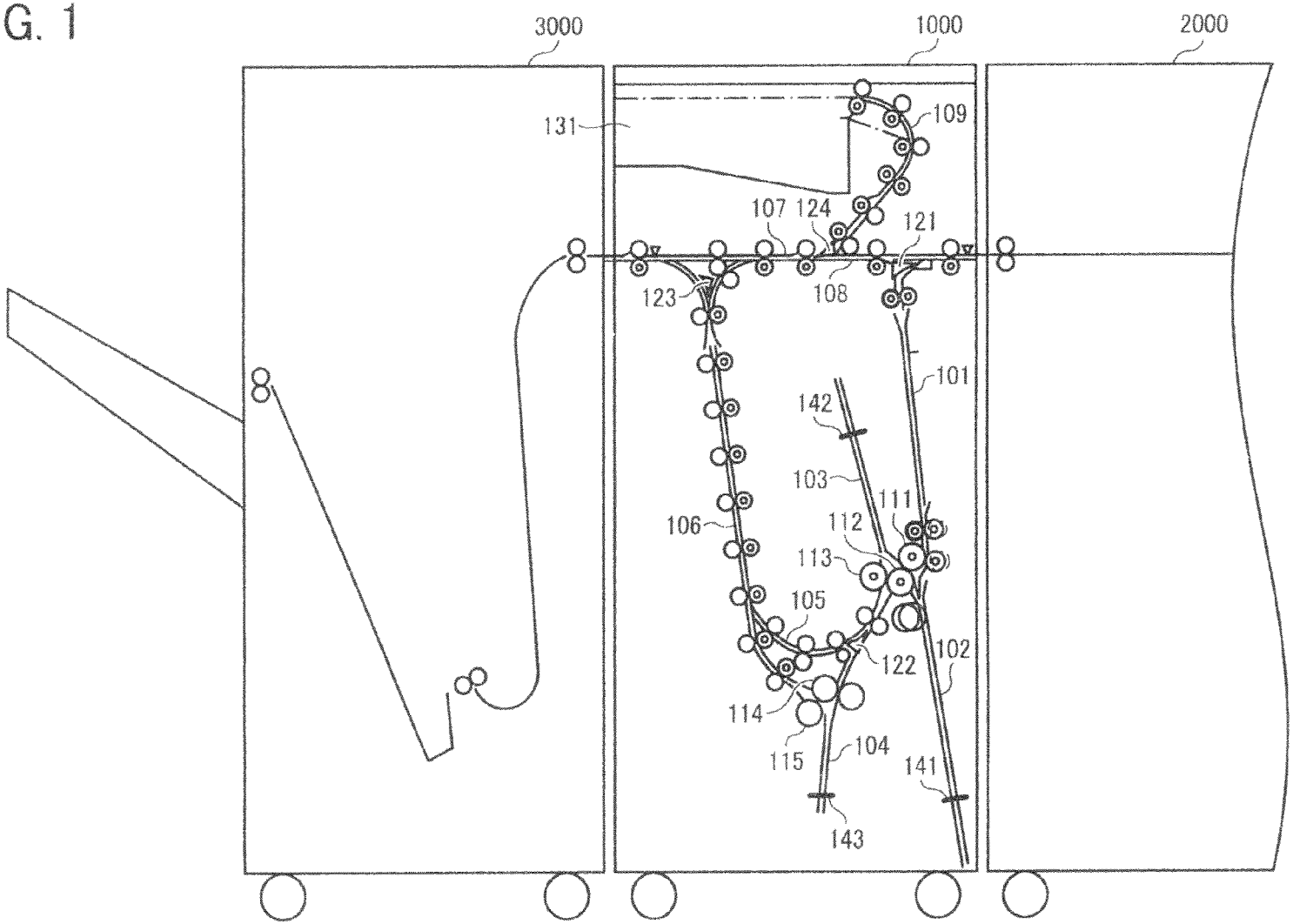
FIG. 1 is an explanation view illustrating a system configuration of an image forming apparatus connected with a sheet folding device according to an embodiment of the invention.

In an embodiment which will be described below, a transport unit corresponds to a first folding roller 111 and a driven roller 111*a* and first to fifth folding rollers 111 to 115, an abutting unit corresponds to first to third stoppers 141 to 143, a folding unit corresponds to first to fifth folding rollers 111 to 115, a guide member corresponds to first to third movable guide plates 301, 302, and 303, a position adjustment unit corresponds to rotation pivot points 501 and 601, a driving source 701, and gears 702 and 703, an operation unit corresponds to an operation panel 2100, a sheet (a sheet member) corresponds to a symbol P, a sheet folding device corresponds to a reference numeral 1000, and a copy machine (an image forming apparatus) corresponds to a reference numeral 2000, respectively.

The invention makes it possible to adjust the gradient of the folding position while maintaining a distance from a transport unit to a stop member and thus not influencing the folding length and changing the transport path shape. Hereinafter, an embodiment of a sheet folding device according to the present invention will be described. Further, the present invention is not limited to the embodiment.

FIG. 1 is an explanation view illustrating a system configuration of an image forming apparatus connected with a sheet folding device according to an embodiment of the present invention. As illustrated in FIG. 1, the present system mainly includes a sheet folding device 1000 that has a configuration according to the present invention and performs an operation according to the present invention, an image forming apparatus 2000 such as a copy machine, and a sheet post-processing device 3000 that performs post processing such as stapling of a sheet.

Figure 2:
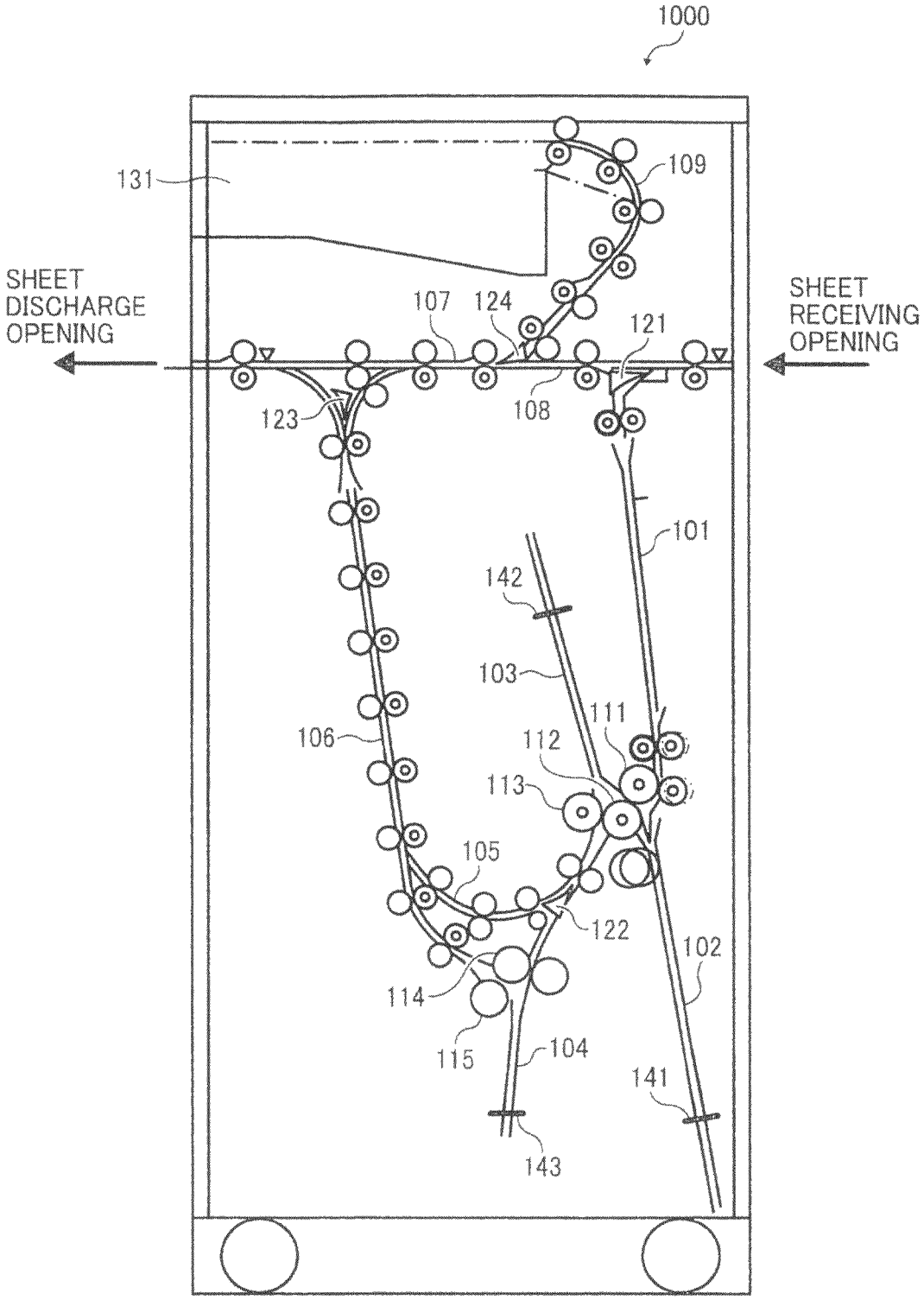
FIG. 2 is a conceptual cross-sectional view illustrating a configuration of a sheet folding device.

FIG. 2 is a conceptual cross-sectional view illustrating a configuration of the sheet folding device 1000. By this configuration, folding operations of single folding, Z folding, outside triple folding, inside triple folding, simple quadruple folding, and gate folding can be performed.

An outline of an operation of the system illustrated in FIGS. 1 and 2 will be described. A sheet, which has an image formed thereon and is transported from the image forming apparatus 2000 at an upstream side in a sheet transport direction is transported to the sheet folding device 1000 through a sheet receiving opening. The sheet folding device 1000 includes first to ninth transport paths 101 to 109, first to fifth folding rollers 111 to 115, first to fourth switching claws 121 to 124, a sheet receiving section 131, and first to third stoppers 141 to 143. In order to transport the sheet to the sheet post-processing device 3000 at a downstream side in the sheet transport direction without performing folding in the sheet folding device 1000, the sheet is guided to the eighth transport path 108 and the seventh transport path 107 by the first switching claw 121 and discharged through a sheet discharge opening. In the case of performing folding, the sheet is guided to the transport paths inside of the sheet folding device 1000 by the first switching claw 121, and corresponding folding operation is performed. After folding is completed, additional folding is performed by an additional folding roller section 308.

Z folding will be described.

First, the sheet is guided to the first transport path 101 by the first switching claw 121. A guide member (not shown) is moved to a nip section between the first folding roller 111 and the second folding roller 112. The sheet is guided by the guide member not to enter the second transport path 102 but to pass through the nip section between the first folding roller 111 and the second folding roller 112, and is directed directly to the third transport path 103. A leading end of the sheet abuts the second stopper 142 which is movable to a folding position located in the third transport path 103. A portion of the sheet bent due to abutting enters a nip between the second folding roller 112 and the third folding roller 113, so that first folding is performed. The sheet which was first folded is transported to the fourth transport path 104 by the second switching claw 122.

The leading end of the sheet transported to the fourth transport path 104 abuts the third stopper 143 which is movable to the folding position located in the fourth transport path 104. Similarly as described above, a portion of the sheet is bent, and the bent portion of the sheet enters a nip between the fourth folding roller 114 and the fifth folding roller 115, so that second folding is performed. Accordingly, Z folding is completed. After folding is completed, the sheet passes through the sixth transport path 106, is guided to the seventh transport path 107 by the third switching claw 123, guided to the ninth transport path 109 by the fourth switching claw 124, and then stacked on the sheet receiving section 131. In the case of transporting the sheet to the sheet post-processing device 3000, the sheet is transported by the third switching claw 123.

Next, single folding will be described.

Figure 3A:
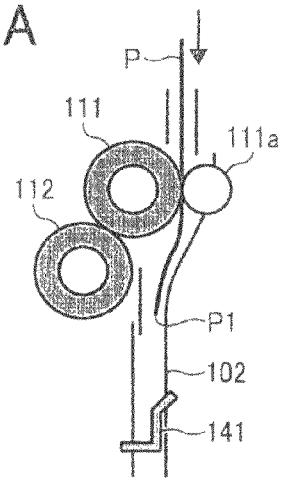
FIGS. 3A to 3D are operation explanation views illustrating a single folding operation in the sheet folding device of FIG. 2.
Figure 3B:
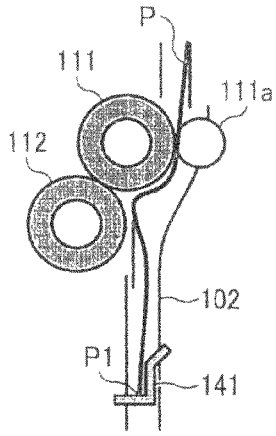
Figure 3C:
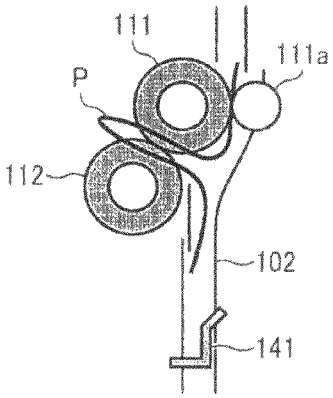
Figure 3D:
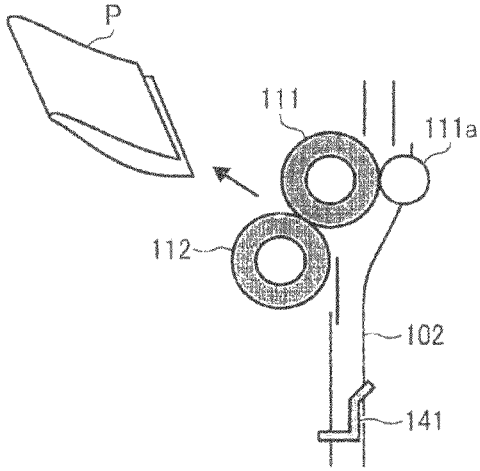

FIGS. 3A to 3D are operation explanation views illustrating a single folding operation. The sheet P is guided to the first transport path 101 by the first switching claw 121. As illustrated in FIG. 3A, the sheet is transported to the downstream by the first folding roller 111 and a driven roller 111*a*, and a leading end P1 of the sheet abuts the first stopper 141 which is movable to the folding position located in the second transport path 102. A portion of the sheet is bent due to this abutting as illustrated in FIG. 3B, and the bent portion enters the nip between the first folding roller 111 and the second folding roller 112 and is folded as illustrated in FIG. 3C, so that single folding is completed as illustrated in FIG. 3D. Then, the guide member (not shown) is moved and guides the sheet P which was single-folded not to enter the third transport path 103 but to pass through the nip between the second folding roller 112 and the third folding roller 113 and be directed to the fifth transport path 105 by the second switching claw 122.

The sheet P passes through the sixth transport path 106, is guided from the seventh transport path 107 to the ninth transport path 109 by the third switching claw 123, and stacked on the sheet receiving section 131. In the case of transporting the sheet to the sheet post-processing device 3000, the sheet is transported by the third switching claw 123.

Next, outside triple folding, inside triple folding, and simple quadruple folding will be described.

These foldings is a technique of performing folding twice with an equal folding width. In these foldings, the sheet is guided to the first transport path 101 by the first switching claw 121. The leading end of the sheet abuts the first stopper 141 which is movable to the folding position located in the second transport path 102. A part of the sheet bent due to this abutting enters the nip between the first folding roller 111 and the second folding roller 112, so that first folding is performed. The sheet which was once folded is transported to the third transport path 103. The leading end of the sheet abuts the second stopper 142 which is movable to the folding position located in the third transport path 103, and a bent portion of the sheet similarly generated enters the nip between the second folding roller 112 and the third folding roller 113, so that second folding is performed. Accordingly, folding is completed.

After folding is completed, the sheet is guided to the fifth transport path 105 by the second switching claw 122. The sheet passes through the sixth transport path 106, guided to the seventh transport path 107 by the third switching claw 123, and then stacked on the sheet receiving section 131 through the ninth transport path 109. In the case of transporting the sheet to the sheet post-processing device 3000, a side different from the seventh transport path 107 is selected by the third switching claw 123, and the sheet is transported to the selected side.

Next, gate folding will be described.

Gate folding is a technique of performing folding three times with an equal folding width. The sheet P is guided to the first transport path 101 by the first switching claw 121. A leading end of the sheet abuts the first stopper 141 which is movable to the folding position located in the second transport path 102, so that the sheet is bent. The bent portion of the sheet enters the nip between the first folding roller 111 and the second folding roller 112, so that first folding is performed. The folded sheet P is transported to the third transport path 103. The leading end of the sheet abuts the second stopper 142 which is movable to the folding position located in the third transport path 103, and a bent portion of the sheet thus generated enters the nip between the second folding roller 112 and the third folding roller 113, so that second folding is performed. When second folding is completed, the sheet is transported to the fourth transport path 104 by the second switching claw 122. The leading end of the sheet abuts the third stopper 143 which is movable to the folding position located in the fourth transport path 104, and a bent portion of the sheet thus generated enters the nip between the fourth folding roller 114 and the fifth folding roller 115, so that third folding is performed. Accordingly, gate folding is completed.

After folding is completed, the sheet passes through the sixth transport path 106, guided to the seventh transport path 107 by the third switching claw 123, and then stacked on the sheet receiving section 131 through the ninth transport path 109. In the case of transporting the sheet to the sheet post-processing device 3000, a side different from the seventh transport path 107 is selected by the third switching claw 123, and the sheet is transported to the selected side.

Figure 4:
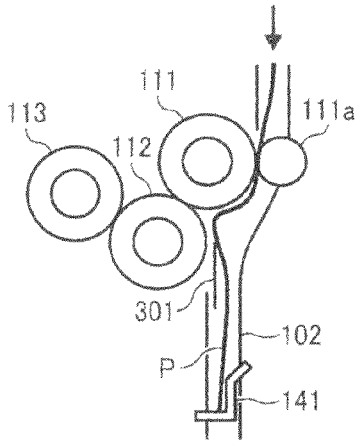
FIG. 4 is a main part front view illustrating an example in which a movable guide plate is disposed directly ahead of a nip between first and second folding rollers.
Figure 5:
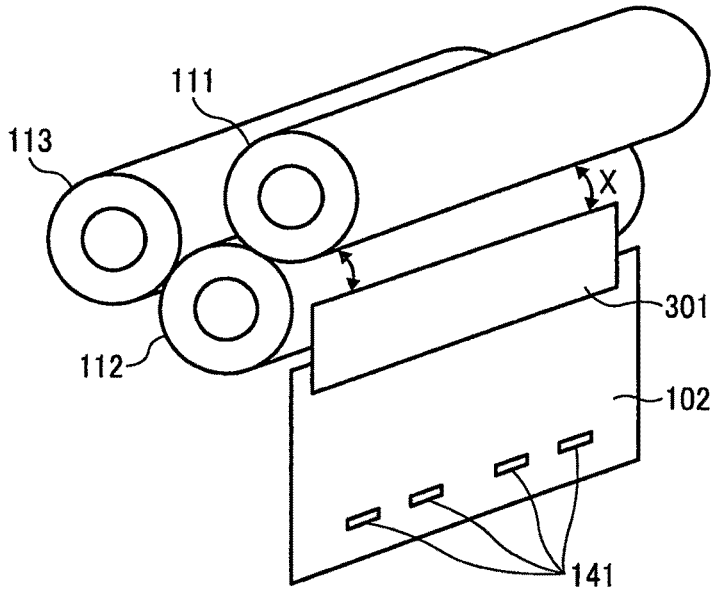
FIG. 5 is a perspective view of FIG. 4.

FIG. 4 is a main part front view illustrating a schematic configuration in a section of the first to third rollers in the present embodiment, and FIG. 5 is a perspective view illustrating the section of the first to third rollers. The embodiment will be described in detail with reference to FIGS. 4 and 5. In the present embodiment, as illustrated in FIGS. 4 and 5, a movable guide plate 301 is disposed at a position which is directly ahead of the nip between the first folding roller 111 and the second folding roller 112 and partially covers the second folding roller 112. An exposure amount of the second folding roller 112 facing the second transport path 102 side can be adjusted by a movement amount of the movable guide plate 301 (which is indicated by an arrow X in FIG. 5).

That is, since it is enough that only the exposure amount of the nip between the first folding roller 111 and the second folding roller 112 can be adjusted, a transport distance from the first folding roller 111 and the driven roller 111*a* to the first stopper 141 of the stopper unit is maintained constant, and the transport path shape does not change. Further, since the transport distance is also maintained constant, the folding length of the sheet P is not influenced, and the transport path shape does not change, thereby preventing wrinkles.

Similarly, since it is enough that only the exposure amount of the nip between the first folding roller 111 and the second folding roller 112 can be adjusted, the size of the movable guide plate 301 can be made very small, and a mechanism can be simplified. Since the size is small, it is possible to save the space and realize a low-price gradient adjustment mechanism.

FIG. 5 illustrates that the exposure amount is adjusted by adjusting a movement amount (an adjustment value) X of the movable guide plate 301. The adjustment amounts X of both ends (the device front and rear sides) of the movable guide plate 301 are independent of each other. Since adjustment to an arbitrary amount at each side can be performed, and thus this method is excellent in an adjustment function, but as the degree of freedom of adjustment is higher, an adjustment time is longer.

Figure 6:
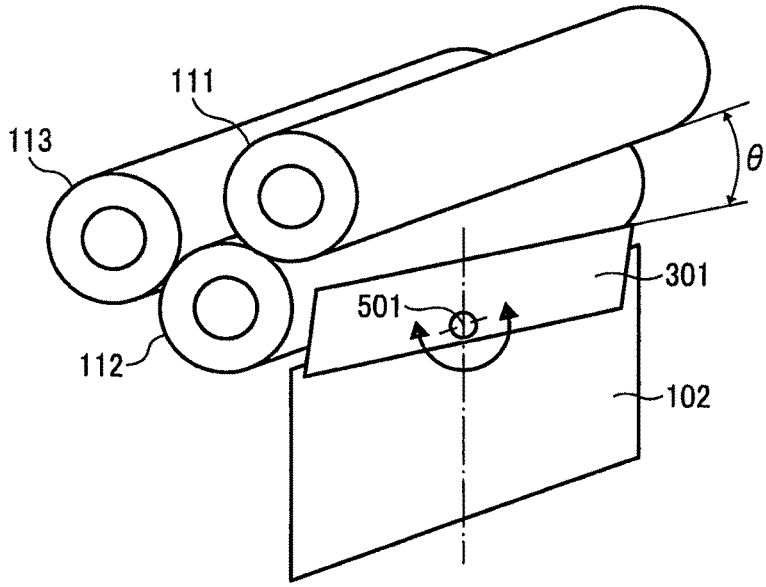
FIG. 6 is a perspective view illustrating an example of an adjustment mechanism in which a rotational center of a movable guide plate is set at a transport center.
Figure 7:
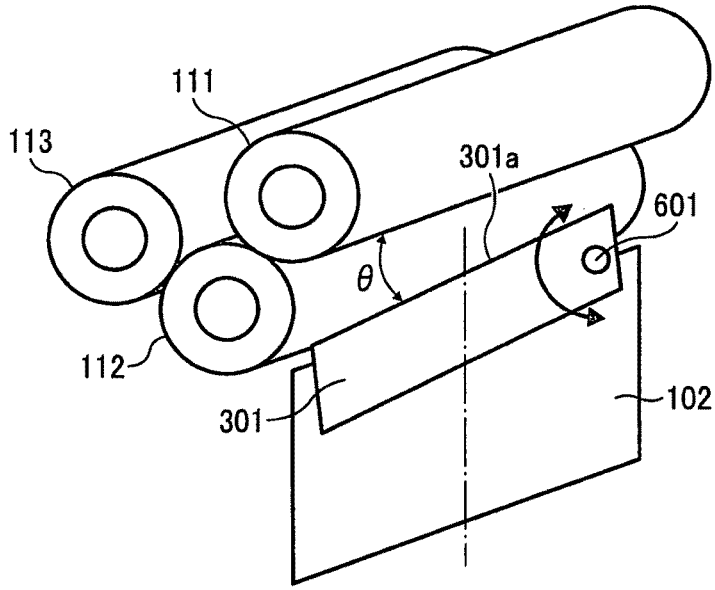
FIG. 7 is a perspective view illustrating an example of an adjustment mechanism in which a rotational center of a movable guide plate is set at a device rear side.

For this reason, for example, as illustrated in FIGS. 6 and 7, a rotation pivot point 501 or 601 may be disposed in the movable guide plate 301. The movable guide plate 301 rotates (swings) about the rotation pivot point 501 or 601 to adjust a gradient of an edge 301*a* of the movable guide plate 301 at the nip side between the first and second folding rollers 111 and 112.

FIG. 6 illustrates an example in which the rotation center 501 is disposed at a center of the movable guide plate 301 in a direction orthogonal to the sheet transport direction, and FIG. 7 illustrates an example in which the rotation center 501 is disposed in the device rear side. In the example of FIG. 6, roller exposure amounts of the front side and the rear side can be adjusted by rotating the movable guide plate 301 on the rotation pivot point 501 disposed in the transport center. In the example of FIG. 7, the roller exposure amount at the front side with respect to at the rear side is adjusted by rotating the movable guide plate 301 about the rotation pivot point 601 disposed in the rear side end section.

In the case of FIGS. 6 and 7, after adjustment, the movable guide plate 301 needs to be fixed. For example, a method in which a user fixes the movable guide plate 301 to a transport guide plate of the second transport path 102 by a fixing member (not shown) is employed for fixing.

Since adjustment in this case is performed by a human hand, adjustment needs to be performed using a gauge for adjusting an interval, for example. Thus, even though the degree of freedom in the adjustment is 1, it is undeniable that adjustment is very troublesome.

Figure 8:
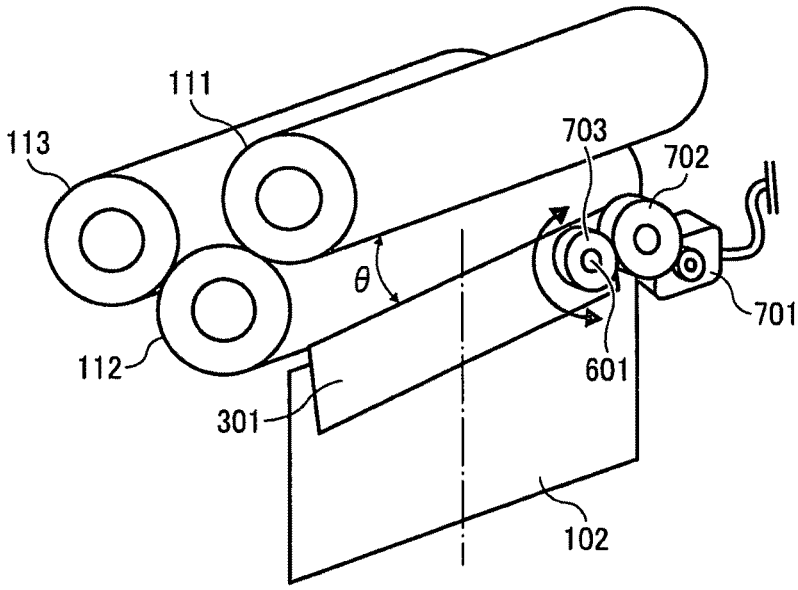
FIG. 8 is a perspective view illustrating an example in which a driving mechanism for driving the adjustment mechanism illustrated in FIG. 7 is added.

FIG. 8 is a view illustrating a driving mechanism which enables adjustment to be performed by the system. In this example, the guide plate 301 which is movable about a rear side end serving as the rotation pivot point 601 is configured to be swigged about the rotation pivot point 601 by motor driving. Specifically, a driven gear 703 that uses the rotation support point 601 as a rotation axis is disposed, and the gear 703 and a gear 702 meshed with the gear 703 constitute a gear train. The gear train is connected with a driving gear of a driving source 701 (a driving motor). An operation section at a main body of the sheet folding device 1000 or the image forming apparatus 2000, for example, an operation panel has an adjustment operation function.

Figures 9A, 9B:
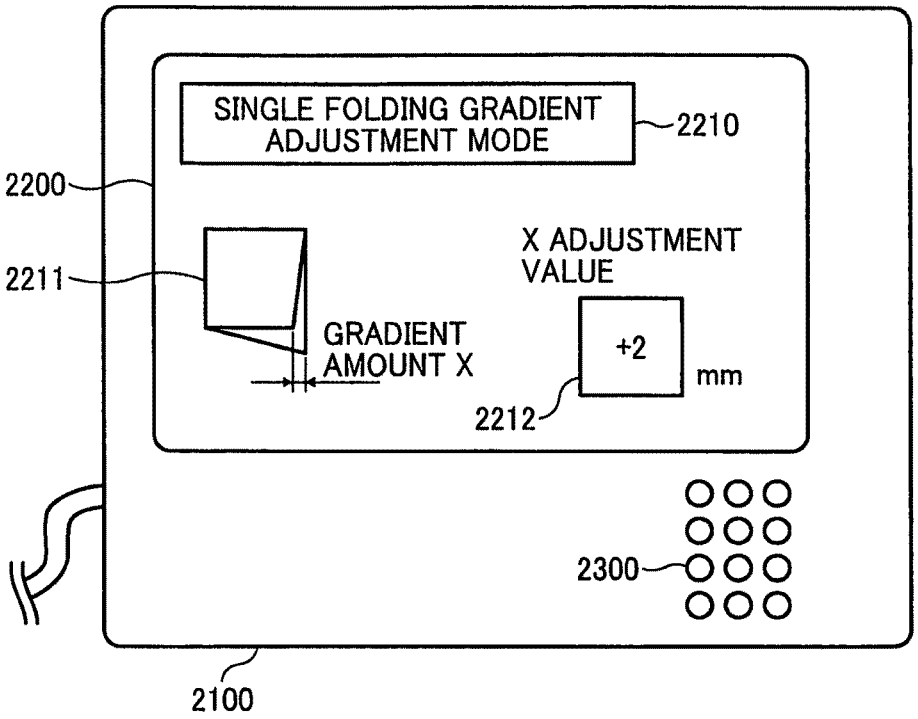
FIGS. 9A and 9B are views illustrating an operation panel having an adjustment function for driving the driving mechanism illustrated in FIG. 8 and performing adjustment and a conversion table used for adjustment, respectively.

FIGS. 9A and 9B are views for explaining an adjustment operation function. FIG. 9A is a front view illustrating an input screen of an operation panel having an adjustment operation function, and FIG. 9B is a view illustrating a relationship between an adjustment value (a gradient amount) X and a guide plate rotation amount θ. In FIG. 9A, an operation display screen 2200 and a ten key 2300 are disposed on an operation panel 2100 of the image forming apparatus 2000. A message 2210, a gradient amount 2211, and an adjustment value X 2212 are displayed on the operation display screen 2200. The adjustment value X is numerically input by the ten key 2300.

Figure 10A:
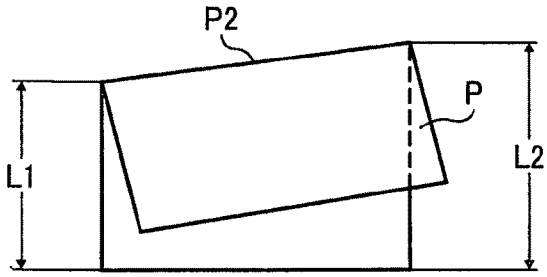
FIGS. 10A and 10B are views illustrating a state before and after adjustment is performed by the gradient adjustment function using the movable guide plate.

For example, in the case of single folding, as illustrated in FIG. 10A, when a fold line P2 of the folded sheet P is inclined and the gradient amount X is "L2-L1", the adjustment amount is also X. At this time, L1 and L2 represent distances from a sheet end of the sheet P to both ends of the fold line P2, respectively.

Figure 10B:
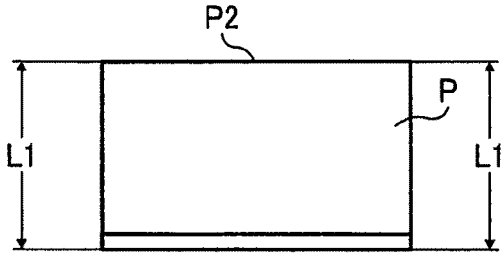

When a "single folding gradient adjustment mode" is selected by a selection button (not shown) of the operation panel 2100, the input screen illustrated in FIG. 9A is displayed, and the adjustment amount (the adjustment value) X (here, "+2"mm) corresponding to the gradient amount X is input on the screen by the ten key 2300. A central processing unit (CPU) of a control section (not shown) of the image forming apparatus 2000 computes the rotation amount θ using the gradient amount x-guide plate rotation amount θ conversion table illustrated in FIG. 9B and drives the driving source by an amount corresponding to the angle. As a result, the gradient of the movable guide plate 301 can be compensated, and the fold line P2 of the folded sheet can be made parallel with the sheet end as illustrated in FIG. 10B, so that the distances from the sheet end of the sheet P to both ends of the fold line P2 can be made equal, that is, L1.

In the above-described configuration, since the gradient angle θ of the movable guide plate 301 can be adjusted only by inputting the adjustment value X through the operation panel 2100, operability is greatly improved.

Figure 11:
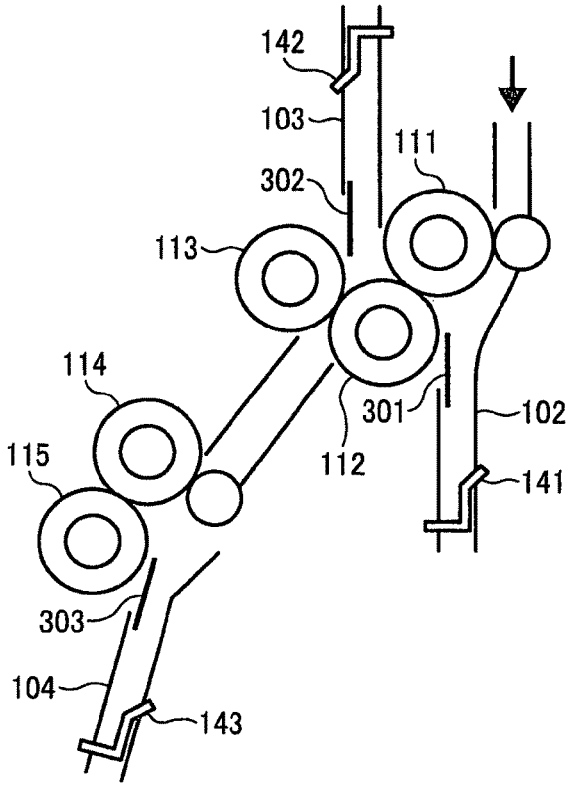
FIG. 11 is a view illustrating a state in which a movable guide plate is disposed directly ahead of a nip of each folding roller pair having a folding function.

The movable guide plate (hereinafter, referred to as "a first movable guide plate") 301 can be disposed not only at a position directly ahead of the nip between the first and second folding rollers 111 and 112 as illustrated in FIGS. 4 to 8, but also as a second movable guide plate 302 at a position partially covering the third folding roller 113 directly ahead of the nip between the second and third folding rollers 112 and 113, which perform folding operation similar to the first and second folding rollers 111 and 112, and as a third movable guide plate 303 at a position partially covering the fifth folding roller 115 directly ahead of the nip between the fourth and fifth folding rollers 114 and 115, which perform folding operation similar to the first and second folding rollers 111 and 112, as illustrated in FIG. 11.

When the first to third movable guide plates 301, 302, and 303 are disposed as described above, since it is possible to adjust the exposure amounts of the second folding roller 112, the third folding roller 113, and the fifth folding roller 115, respectively, facing the second transport path 102 side, the third transport path 103 side, and the fourth transport path 104 side, it is possible to adjust the folding direction at each fold line. As a result, it is possible to adjust the folding directions in multiple times of folding such as in Z folding, triple folding, and gate folding with high degree of accuracy, thereby greatly improving the folding quality.

As described above, according to the present embodiment, the gradient of the folding position can be adjusted while maintaining constant distance from the transport unit to the stop member, not influencing the folding length and not changing the transport path shape. Further, it is not necessary to make the whole guide plate movable and it is enough that only the exposure amount of the folding roller nip can be adjusted, the size of the guide plate can be made very small, and a mechanism can be simplified.

Further, when the rotating pivot point 501 for angle adjustment is disposed at the transport center, since a gradient change occurs at both sides of the rotating pivot point 501 when rotation is performed by a certain angle, it is possible to perform adjustment with a small amount.

Further, when the rotating pivot point 601 for angle adjustment is disposed on one side end, operability of gradient adjustment is improved. Further, when gradient adjustment is performed, if a length to a folded point at the movable side is shorter than that at the pivot point side, it can be seen that an inclined angle θ should be adjusted in a direction that makes the angle θsmaller than 0 (θ<0). If a length to a folded point at the movable side is longer than that at the pivot point side, it can be seen that an inclined angle θ should be adjusted in a direction that makes the angle θ greater than 0 (θ>0). Thus, the difference between the length to the folded point at the pivot point and that at the movable side may be measured and a difference of these lengths may be used as a direct adjustment amount, thereby improving the degree of accuracy in adjustment and operability.

Further, the movable guide plate 301 may be made of metal (particularly, with a thin thickness) such as stainless steel (SUS), resulting in saving space and cost. Further, when Mylar is used, it is possible to adjust the gradient even in a state contacting the folding roller, the exposure amount of which is to be adjusted. Therefore, it is possible to further save the space. In the gradient adjustment effect, SUS (metal) is greater than Mylar (an elastic body).

Furthermore, in the present embodiment, since the driving source 701 is connected, through the gear train 702 and 703, with the rotating pivot point 601 of the movable guide plate 301 that rotates about its end, serving as the rotation pivot point 601, at the rear side of the device, it is possible to adjust the angle of the movable guide plate 301 by rotating the rotating pivot point 601 through the driving source 701 according to the adjustment value input from the operation panel 2100 at the device main body. Accordingly, the operability is greatly improved, and adjustment can be performed with high degree of accuracy according to the resolution of the driving source.

According to the present invention, an exposure amount of a folding roller with respect to a sheet can be varied by position adjustment of a guide member through a position adjustment unit. Thus, the gradient adjustment can be performed without influencing the folding length and generating wrinkles. Since only an exposure amount of a folding roller nip needs to be adjusted without making the whole guide member movable, the size of the guide plate can be made small, and the mechanism can be simplified.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet folding device, comprising:

a transport unit that transports a sheet;

an abutting unit that abuts an end of the sheet being transported to form a bent portion at the sheet;

a folding unit that nips the bent portion of the sheet by a pair of folding rollers to form a fold line in the sheet;

a guide member that partially covers the folding roller and guides the sheet; and a position adjustment unit that adjusts a position of the guide member, wherein:

an exposure amount of the folding roller with respect to the sheet can be varied by adjusting the position of the guide member through the position adjustment unit, the position adjustment unit has a pivot point axis that rotatably supports the guide member, and the guide member is supported by the pivot point axis so that a rotation angle about the pivot point axis is adjustable.

2. The sheet folding device according to claim 1, wherein the pivot point axis is positioned at a center of the guide member in a direction orthogonal to a sheet transport direction.

3. The sheet folding device according to claim 1, wherein the pivot point axis is positioned at an end of the guide member in a direction orthogonal to a sheet transport direction.

4. An image forming apparatus, comprising:

a sheet folding device comprising:

a transport unit that transports a sheet;

an abutting unit that abuts an end of the sheet being transported to form a bent portion at the sheet;

a folding unit that nips the bent portion of the sheet by a pair of folding rollers to form a fold line in the sheet;

a guide member that partially covers the folding roller and guides the sheet; and a position adjustment unit that adjusts a position of the guide member, wherein an exposure amount of the folding roller with respect to the sheet can be varied by adjusting the position of the guide member through the position adjustment unit, the position adjustment unit has a pivot point axis that rotatably supports the guide member, the guide member is supported by the pivot point axis so that a rotation angle about the pivot point axis is adjustable, the pivot point axis is positioned at an end of the guide member in a direction orthogonal to a sheet transport direction, and the image forming apparatus further comprising:

an image forming unit that forms an image on a sheet;

a driving unit that rotatably drives the guide member; and an operation unit that operates the driving unit, wherein a rotation angle of the guide member is adjusted by the operation unit.

5. An image forming apparatus, comprising:

an image forming unit that forms an image on a sheet, and a sheet folding device, including:

a transport unit that transports the sheet;

an abutting unit that abuts an end of the sheet being transported to form a bent portion at the sheet;

a folding unit that nips the bent portion of the sheet by a pair of folding rollers to form a fold line in the sheet;

a guide member that partially covers the folding roller and guides the sheet; and a position adjustment unit that adjusts a position of the guide member, wherein an exposure amount of the folding roller with respect to the sheet can be varied by adjusting the position of the guide member through the position adjustment unit, wherein the position adjustment unit has a pivot point axis that rotatably supports the guide member, and wherein the guide member is supported by the pivot point axis so that a rotation angle about the pivot point axis is adjustable.

6. A sheet folding device, comprising:

a transport unit that transports a sheet;

an abutting unit that abuts an end of the sheet being transported to form a bent portion at the sheet;

a folding unit that nips the bent portion of the sheet by a pair of folding rollers to form a fold line in the sheet;

a guide member that partially covers the folding rollers and guides the sheet; and a position adjustment unit that adjusts a position of the guide member, wherein an overlap amount of the guide member to the folding rollers in an axial direction of the folding rollers is varied by adjusting the position of the guide member through the position adjustment unit, wherein the sheet conveys toward the guide member prior to entering the nip between the pair of folding rollers, wherein the position adjustment unit has a pivot point axis that rotatably supports the guide member, and wherein the guide member is supported by the pivot point axis so that a rotation angle about the pivot point axis is adjustable.

7. The sheet folding device according to claim 6, wherein the guide member is disposed at a position which is directly ahead of the nip between the pair of folding rollers.

8. The sheet folding device according to claim 6, wherein the guide member moves in a same direction as the sheet transport direction.

9. The sheet folding device according to claim 6, wherein the adjustment amounts of both ends of the guide member are independent of each other.

10. The sheet folding device according to claim 6, wherein the pivot point axis is positioned at a center of the guide member in a direction orthogonal to a sheet transport direction.

11. The sheet folding device according to claim 6, wherein the pivot point axis is positioned at an end of the guide member in a direction orthogonal to a sheet transport direction.

12. An image forming apparatus, comprising:

the sheet folding device of claim 6.

13. An image forming apparatus, comprising:

an image forming unit that forms an image on a sheet, and the sheet folding device of claim 6.

14. The sheet folding device according to claim 6, wherein the guide member overlaps with the folding rollers when viewed in a direction orthogonal to a sheet transport direction.

* * * * *